US011583902B2

(12) United States Patent
Costello

(10) Patent No.: US 11,583,902 B2
(45) Date of Patent: Feb. 21, 2023

(54) BED PAN SANITIZING ASSEMBLY

(71) Applicant: Anne Costello, Mitchell (CA)

(72) Inventor: Anne Costello, Mitchell (CA)

( * ) Notice: Subject to any disclaimer, the term of this patent is extended or adjusted under 35 U.S.C. 154(b) by 46 days.

(21) Appl. No.: 17/370,130

(22) Filed: Jul. 8, 2021

(65) Prior Publication Data

US 2023/0009772 A1 Jan. 12, 2023

(51) Int. Cl.
*A61G 9/02* (2006.01)
*B08B 7/00* (2006.01)

(52) U.S. Cl.
CPC ..... *B08B 7/0057* (2013.01); *A61G 9/02* (2013.01)

(58) Field of Classification Search
None
See application file for complete search history.

(56) References Cited

U.S. PATENT DOCUMENTS

| | | | |
|---|---|---|---|
| 1,597,129 | A | 8/1926 | Watters |
| 2,826,208 | A | 3/1958 | Boffa |
| 3,645,283 | A | 2/1972 | Cassells |
| 3,683,638 | A | 8/1972 | Devon |
| 4,015,614 | A | 4/1977 | Jonsson |
| D801,600 | S | 10/2017 | Kim |
| 2003/0034459 | A1 | 2/2003 | Bonin |
| 2010/0266445 | A1 | 10/2010 | Campagna |

*Primary Examiner* — Eric W Golightly

(57) ABSTRACT

A bed pan sanitizing assembly includes a housing and a pair of trays wherein each of the trays is positioned within the housing. Each of the trays can have a respective one of a bed pan and a urine bottle positioned thereon. A pair of light emitting units is positioned within the housing to emit light into an interior of the housing. Each of the light emitting units has an operational frequency within the ultraviolet spectrum to sterilize the bed pan and the urine bottle when the light emitting units are turned on. A heating unit is integrated into the housing to heat the interior of the housing when the heating unit is turned on for enhancing sterilizing the bed pan and the urine bottle.

7 Claims, 4 Drawing Sheets

BED PAN SANITIZING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sanitizing devices and more particularly pertains to a new sanitizing device for sterilizing bed pans and urine bottles. The device includes a housing, a pair of light emitting units and a heating unit. Each of the light emitting units is positioned in the housing and the heating unit is positioned in the housing. A pair of trays is positioned on the housing for supporting a bed pan and a urine bottle. The light emitting units emit ultraviolet light and the heating unit heats the interior of the housing. In this way the bed pan and the urine bottle are sterilized.

(2) Description of Related Art Including Information Disclosed Under 37 CFR 1.97 and 1.98

The prior art relates to sanitizing devices including a variety of washing machines that wash and sanitize a bed pan. The prior art discloses a sterilizing device that includes ultraviolet lights and a dehumidifier for sterilizing equipment in a hospital. The prior art discloses a sterilizing device that includes a housing, a single ultraviolet light emitter and a blower for circulating air in the housing. The prior art also discloses a housing, an ultraviolet light emitter and an ozone generator for sterilizing articles. In no instance does the prior art disclose a housing, a plurality of ultraviolet light emitter and a heating unit for sterilizing articles.

BRIEF SUMMARY OF THE INVENTION

An embodiment of the disclosure meets the needs presented above by generally comprising a housing and a pair of trays that is each of the trays is positioned within the housing. Each of the trays can have a respective one of a bed pan and a urine bottle positioned thereon. A pair of light emitting units is each positioned within the housing to emit light into an interior of the housing. Each of the light emitting units has an operational frequency within the ultraviolet spectrum to sterilize the bed pan and the urine bottle when the light emitting units are turned on. A heating unit is integrated into the housing to heat the interior of the housing when the heating unit is turned on for enhancing sterilizing the bed pan and the urine bottle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
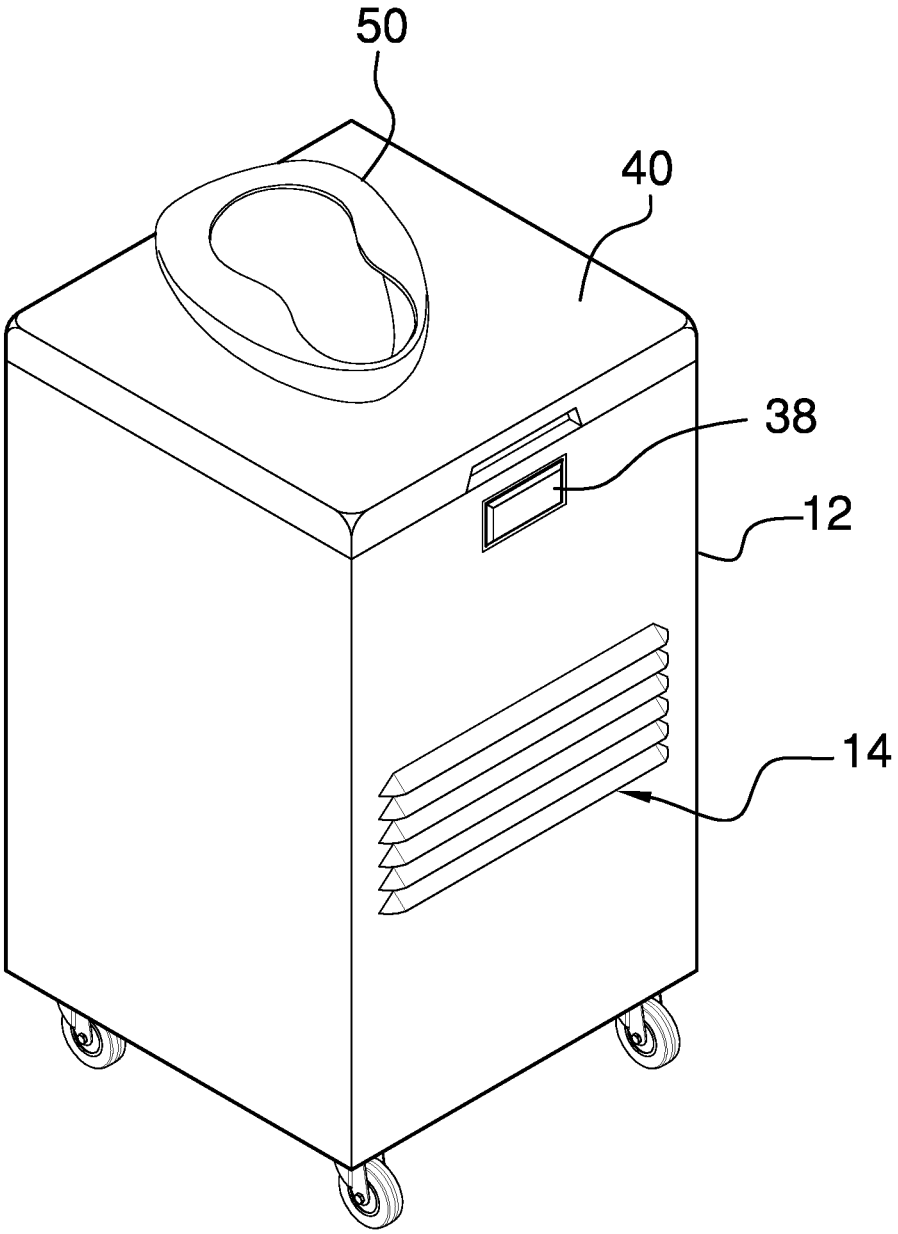
FIG. 1 is a perspective view of a bed pan sanitizing assembly according to an embodiment of the disclosure.
Figure 2:
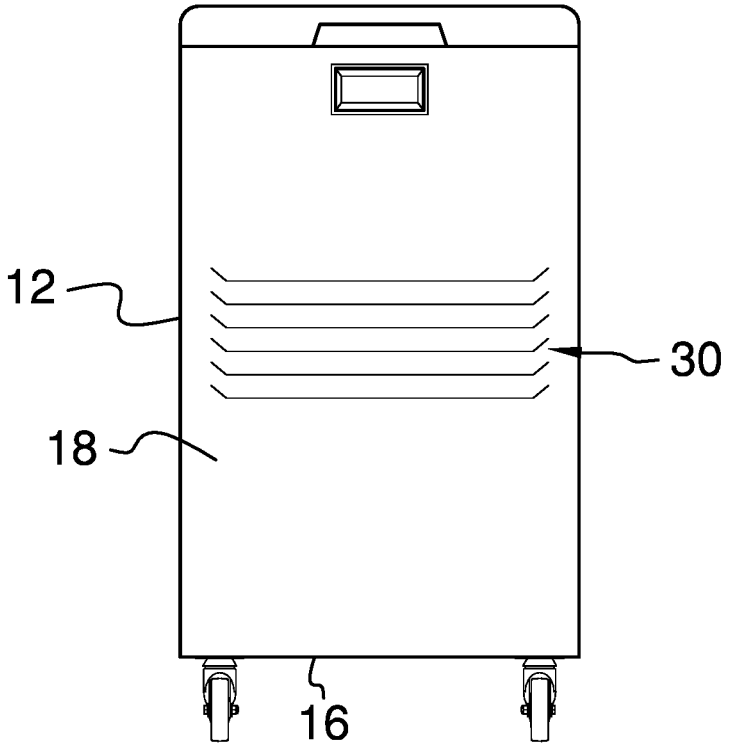
FIG. 2 is a front view of an embodiment of the disclosure.
Figure 3:
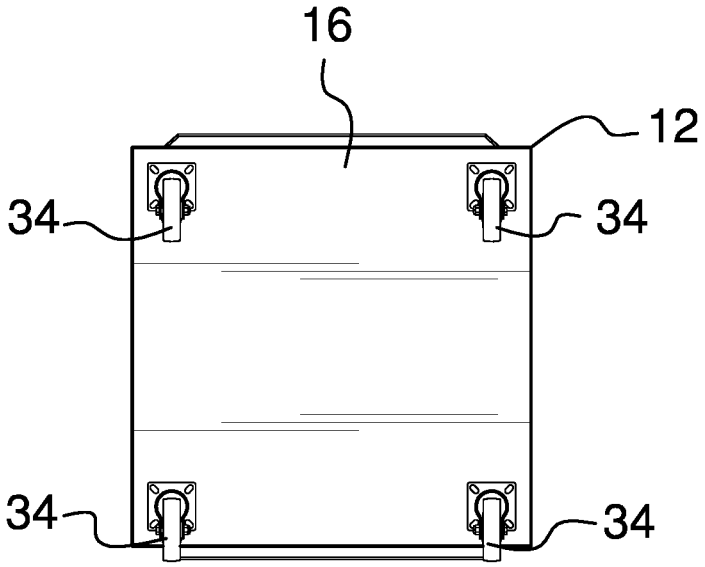
FIG. 3 is a bottom view of an embodiment of the disclosure.
Figure 4:
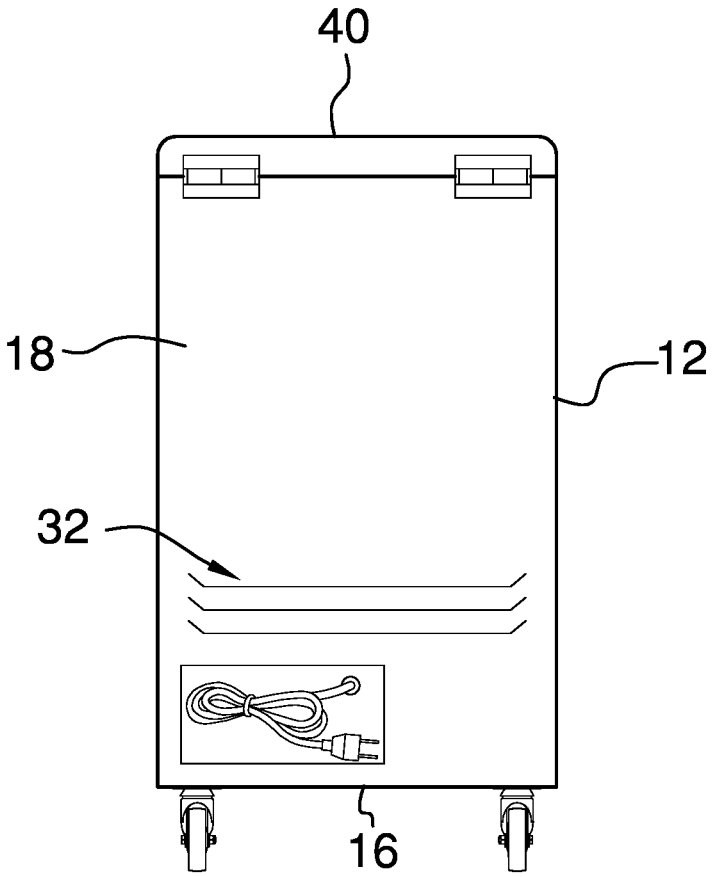
FIG. 4 is a back view of an embodiment of the disclosure.
Figure 5:
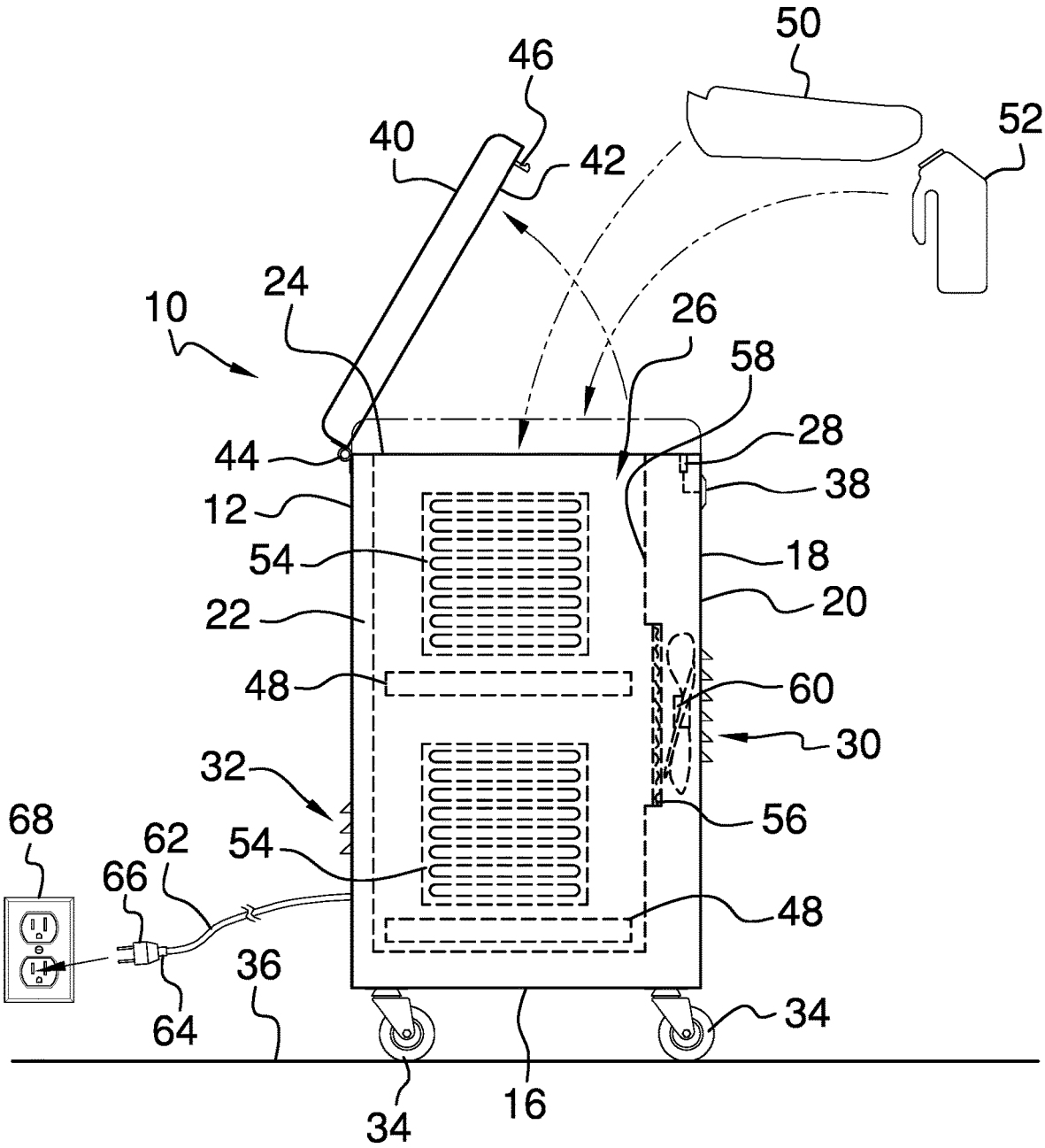
FIG. 5 is a right side phantom view of an embodiment of the disclosure.

With reference now to the drawings, and in particular to FIGS. 1 through 5 thereof, a new sanitizing device embodying the principles and concepts of an embodiment of the disclosure and generally designated by the reference numeral 10 will be described.

As best illustrated in FIGS. 1 through 5, the bed pan sanitizing assembly 10 generally comprises a housing 12 that has a plurality of air vents 14 each being integrated into the housing 12 to facilitate air to pass through the housing 12. The housing 12 has a bottom wall 16 and an outer wall 18 extending upwardly from the bottom wall 16, and the outer wall 18 has a front side 20, a back side 22 and a distal edge 24 with respect to the bottom wall 16. Moreover, the distal edge 24 defines an opening 26 into an interior of the housing 12, the distal edge 24 has an engagement 28 that is recessed into the distal edge 24 and the engagement 28 is positioned on the front side 20 of the outer wall 18. The plurality of air vents 14 includes a set of front air vents 30 each extending through the front side 20 of the outer wall 18, and the plurality of air vents 14 includes a set of back air vents 32 each extending through the back side 22 of the outer wall 18.

A plurality of rollers 34 is each rotatably coupled to the bottom wall 16 of the housing 12 for rolling the housing 12 along a support surface 36. Each of the rollers 34 is aligned with a respective one of four corners of the bottom wall 16.

Each of the rollers 34 may comprise a caster, a wheel or any other type of roller. A release button 38 is movably integrated into the front side 20 of the outer wall 18 of the housing 12. The release button 38 is in mechanical communication with the engagement 28 and the engagement 28 is urged into a releasing condition when the release button 38 is depressed.

A lid 40 is hingedly coupled to the housing 12 for opening 26 and closing the housing 12. The lid 40 has a bottom surface 42 and a back edge 44, and the back edge 44 is hingedly coupled to the back side 22 of the outer wall 18 of the housing 12. The bottom surface 42 rests on the distal edge 24 of the outer wall 18 when the lid 40 is closed. The bottom surface 42 is displaced from the distal edge 24 when the lid 40 is opened. A coupling 46 is coupled to and extends downwardly from the bottom surface 42 of the lid 40. The coupling 46 extends into the engagement 28 when the lid 40 is closed for releasably retaining the lid 40 in a closed position. Additionally, the engagement 28 disengages the coupling 46 when the release button 38 is depressed to facilitate the lid 40 to be opened.

A pair of trays 48 is provided and each of the trays 48 is positioned within the housing 12. The trays 48 are vertically distributed in the housing 12 and each of the trays 48 can have a respective one of a bed pan 50 and a urine bottle 52 positioned thereon. The trays 48 are spaced apart from each other and are distributed between the bottom wall 16 of the housing 12 and the distal edge 24 of the outer wall 18 of the housing 12. The bed pan and the urine bottle 52 may be the type that would commonly be employed in a medical setting for a bedridden patient or the like.

A pair of light emitting units 54 is each positioned within the housing 12 to emit light into an interior of the housing 12. Each of the light emitting units 54 has an operational frequency within the ultraviolet spectrum. In this way each of the light emitting units 54 can sterilize the bed pan 50 and the urine bottle 52 when the light emitting units 54 are turned on. A respective one of the light emitting units 54 is positioned between the pair of trays 48, and a respective one of the light emitting units 54 is positioned between a topmost one of the trays 48 and the distal edge 24 of the outer wall 18 of the housing 12. Each of the light emitting units 54 may include a plurality of light emitting diodes, or other type of electronic light emitter, that emits ultraviolet light.

A heating unit 56 is provided and the heating unit 56 is integrated into the housing 12. The heating unit 56 is in thermal communication with an interior of the housing 12 to heat the interior of the housing 12 when the heating unit 56 is turned on. Additionally, the heating unit 56 is positioned on an inside surface 58 of the front side 20 of the outer wall 18 of the housing 12 and the heating unit 56 is aligned with the set of front air vents 30 in housing 12. The heating unit 56 might include electric heating coils that have an operational temperature of at least 220.0.

A blower 60 is integrated into the housing 12 and the blower 60 is aligned with the heating unit 56. The blower 60 is aligned with respective ones of the air vents 14 to urge air inwardly through the respective air vents 14 and across the heating unit 56 when the blower 60 is turned on. In this way the blower 60 circulates heated air throughout the housing 12 thereby facilitating the heated air to enhance sterilizing the bed pan 50 and the urine bottle 52. The blower 60 is aligned with the set of front air vents 30 in the housing 12, and the blower 60 might include an electric motor and a fan that is rotatably coupled to the motor.

A power cord 62 is coupled to and extends away from the outer wall 18 of the housing 12. The power cord 62 is electrically coupled to each of the light emitting units 54, the heating unit 56 and the blower 60. The power cord 62 has a distal end 64 with respect to the outer wall 18 and a male plug 66 is electrically coupled to the distal end 64. Additionally, the male plug 66 can be electrically coupled to a power source 68 comprising a female electrical outlet.

In use, the bed pan 50 and the urine bottle 52 are positioned on one of the trays 48, the lid 40 is closed and the power cord 62 is plugged into the power source 68. Each of the light emitting units 54, the heating unit 56 and the blower 60 are turned on when the power cord 62 is plugged in. In this way bed pan 50 and the urine bottle 52 are sterilized with ultraviolet radiation and with heat. The power cord 62 is left plugged in for a sufficient duration of time to fully sterilize the bed pan 50 and the urine bottle 52. In this way the risk of transmission of infectious diseases is significantly reduced, thereby enhancing the health and safety of caregivers that are caring for the bedridden patient. The power cord 62 is unplugged, the release button 38 is depressed to facilitate the lid 40 to be opened and each of the bed pan 50 and the urine bottle 52 are removed from the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bed pan sanitizing assembly for sanitizing a bed pan between uses thereby enhancing the health and safety of health care workers, said assembly comprising:

a housing having a plurality of air vents each being integrated into said housing wherein said plurality of air vents is configured to facilitate air to pass through said housing;

a lid being hingedly coupled to said housing for opening and closing said housing;

a pair of trays, each of said trays being positioned within said housing, said trays being vertically distributed in said housing wherein each of said trays is configured to have a respective one of a bed pan and a urine bottle being positioned thereon;

a pair of light emitting units, each of said light emitting units being positioned within said housing wherein each of said light emitting units is configured to emit light into an interior of said housing, each of said light emitting units having an operational frequency within the ultraviolet spectrum wherein each of said light emitting units is configured to sterilize the bed pan and the urine bottle when said light emitting units are turned on;

a heating unit being integrated into said housing, said heating unit being in thermal communication with an interior of said housing wherein said heating unit is configured to heat the interior of said housing when said heating unit is turned on; and a blower being integrated into said housing, said blower being aligned with said heating unit, said blower being aligned with respective ones of said air vents wherein said blower is configured to urge air inwardly through said respective air vents and across said heating unit for circulating heated air throughout said housing thereby facilitating the heated air to enhance sterilizing the bed pan and the urine bottle.

2. The assembly according to claim 1, wherein said housing has a bottom wall and an outer wall extending upwardly from said bottom wall, said outer wall having a front side, a back side and a distal edge with respect to said bottom wall, said distal edge defining an opening into an interior of said housing, said distal edge having an engagement being recessed into said distal edge, said engagement being positioned on said front side of said outer wall, said plurality of air vents including a set of front air vents each extending through said front side of said outer wall, said plurality of air vents including a set of back air vents each extending through said back side of said outer wall.

3. The assembly according to claim 2, wherein:

said assembly includes a release button being movably integrated into said front side of said outer wall of said housing, said release button being in mechanical communication with said engagement, said engagement being urged into a releasing condition when said release button is depressed;

said lid has a bottom surface and a back edge, said back edge being hingedly coupled to said back side of said outer wall of said housing, said bottom surface resting on said distal edge of said outer wall when said lid is closed, said bottom surface being displaced from said distal edge when said lid is opened; and said assembly includes a coupling being coupled to and extending downwardly from said bottom surface of said lid, said coupling extending into said engagement in said distal edge of said outer wall of said housing when said lid is closed for releasably retaining said lid in a closed position, said engagement disengaging said coupling when said release button is depressed to facilitate said lid to be opened.

4. The assembly according to claim 2, wherein:

said trays are spaced apart from each other and are distributed between said bottom wall of said housing and said distal edge of said outer wall of said housing; and a respective one of said light emitting units is positioned between said pair of trays, a respective one of said light emitting units being positioned between a topmost one of said trays and said distal edge of said outer wall of said housing.

5. The assembly according to claim 2, wherein:

said heating unit is positioned on an inside surface of said front side of said outer wall of said housing, said heating unit being aligned with said set of front air vents in said housing; and said blower is aligned with said set of front air vents in said housing.

6. A bed pan sanitizing assembly for sanitizing a bed pan between uses thereby enhancing the health and safety of health care workers, said assembly comprising:

a housing having a plurality of air vents each being integrated into said housing wherein said plurality of air vents is configured to facilitate air to pass through said housing, said housing having a bottom wall and an outer wall extending upwardly from said bottom wall, said outer wall having a front side, a back side and a distal edge with respect to said bottom wall, said distal edge defining an opening into an interior of said housing, said distal edge having an engagement being recessed into said distal edge, said engagement being positioned on said front side of said outer wall, said plurality of air vents including a set of front air vents each extending through said front side of said outer wall, said plurality of air vents including a set of back air vents each extending through said back side of said outer wall;

a plurality of rollers, each of said rollers being rotatably coupled to said bottom wall of said housing wherein each of said rollers is configured to roll said housing along a support surface, each of said rollers being aligned with a respective one of four corners of said bottom wall;

a release button being movably integrated into said front side of said outer wall of said housing, said release button being in mechanical communication with said engagement, said engagement being urged into a releasing condition when said release button is depressed;

a lid being hingedly coupled to said housing for opening and closing said housing, said lid having a bottom surface and a back edge, said back edge being hingedly coupled to said back side of said outer wall of said housing, said bottom surface resting on said distal edge of said outer wall when said lid is closed, said bottom surface being displaced from said distal edge when said lid is opened;

a coupling being coupled to and extending downwardly from said bottom surface of said lid, said coupling extending into said engagement in said distal edge of said outer wall of said housing when said lid is closed for releasably retaining said lid in a closed position, said engagement disengaging said coupling when said release button is depressed to facilitate said lid to be opened;

a pair of trays, each of said trays being positioned within said housing, said trays being vertically distributed in said housing wherein each of said trays is configured to have a respective one of a bed pan and a urine bottle being positioned thereon, said trays being spaced apart from each other and being distributed between said bottom wall of said housing and said distal edge of said outer wall of said housing;

a pair of light emitting units, each of said light emitting units being positioned within said housing wherein each of said light emitting units is configured to emit light into an interior of said housing, each of said light emitting units having an operational frequency within the ultraviolet spectrum wherein each of said light emitting units is configured to sterilize the bed pan and the urine bottle when said light emitting units are turned on, a respective one of said light emitting units being positioned between said pair of trays, a respective one of said light emitting units being positioned between a topmost one of said trays and said distal edge of said outer wall of said housing;

a heating unit being integrated into said housing, said heating unit being in thermal communication with an interior of said housing wherein said heating unit is configured to heat the interior of said housing when said heating unit is turned on, said heating unit being positioned on an inside surface of said front side of said outer wall of said housing, said heating unit being aligned with said set of front air vents in said housing;

a blower being integrated into said housing, said blower being aligned with said heating unit, said blower being aligned with respective ones of said air vents wherein said blower is configured to urge air inwardly through said respective air vents and across said heating unit for circulating heated air throughout said housing thereby facilitating the heated air to enhance sterilizing the bed pan and the urine bottle, said blower being aligned with said set of front air vents in said housing; and a power cord being coupled to and extending away from said outer wall of said housing, said power cord being electrically coupled to each of said light emitting units, said heating unit and said blower, said power cord having a distal end with respect to said outer wall, said distal end having a male plug being electrically coupled thereto wherein said male plug is configured to be electrically coupled to a power source comprising a female electrical outlet.

7. A bed pan sanitizing system for sanitizing a bed pan between uses thereby enhancing the health and safety of health care workers, said system comprising:

a bed pan being configured to be positioned beneath a bedridden patient for capturing urine and feces from the bedridden patient;

a urine bottle being configured to capture urine from a patient;

a housing having a plurality of air vents each being integrated into said housing wherein said plurality of air vents is configured to facilitate air to pass through said housing, said housing having a bottom wall and an outer wall extending upwardly from said bottom wall, said outer wall having a front side, a back side and a distal edge with respect to said bottom wall, said distal edge defining an opening into an interior of said housing, said distal edge having an engagement being recessed into said distal edge, said engagement being positioned on said front side of said outer wall, said plurality of air vents including a set of front air vents each extending through said front side of said outer wall, said plurality of air vents including a set of back air vents each extending through said back side of said outer wall;

a plurality of rollers, each of said rollers being rotatably coupled to said bottom wall of said housing wherein each of said rollers is configured to roll said housing along a support surface, each of said rollers being aligned with a respective one of four corners of said bottom wall;

a release button being movably integrated into said front side of said outer wall of said housing, said release button being in mechanical communication with said engagement, said engagement being urged into a releasing condition when said release button is depressed;

a lid being hingedly coupled to said housing for opening and closing said housing, said lid having a bottom surface and a back edge, said back edge being hingedly coupled to said back side of said outer wall of said housing, said bottom surface resting on said distal edge of said outer wall when said lid is closed, said bottom surface being displaced from said distal edge when said lid is closed;

a coupling being coupled to and extending downwardly from said bottom surface of said lid, said coupling extending into said engagement in said distal edge of said outer wall of said housing when said lid is closed for releasably retaining said lid in a closed position, said engagement disengaging said coupling when said release button is depressed to facilitate said lid to be opened;

a pair of trays, each of said trays being positioned within said housing, said trays being vertically distributed in said housing, each of said trays having a respective one of said bed pan and said urine bottle being positioned thereon, said trays being spaced apart from each other and being distributed between said bottom wall of said housing and said distal edge of said outer wall of said housing;

a pair of light emitting units, each of said light emitting units being positioned within said housing wherein each of said light emitting units is configured to emit light into an interior of said housing, each of said light emitting units having an operational frequency within the ultraviolet spectrum to sterilize said bed pan and said urine bottle when said light emitting units are turned on, a respective one of said light emitting units being positioned between said pair of trays, a respective one of said light emitting units being positioned between a topmost one of said trays and said distal edge of said outer wall of said housing;

a heating unit being integrated into said housing, said heating unit being in thermal communication with an interior of said housing wherein said heating unit is configured to heat the interior of said housing when said heating unit is turned on, said heating unit being positioned on an inside surface of said front side of said outer wall of said housing, said heating unit being aligned with said set of front air vents in said housing;

a blower being integrated into said housing, said blower being aligned with said heating unit, said blower being aligned with respective ones of said air vents wherein said blower is configured to urge air inwardly through said respective air vents and across said heating unit for circulating heated air throughout said housing thereby facilitating the heated air to enhance sterilizing said bed pan and said urine bottle, said blower being aligned with said set of front air vents in said housing; and a power cord being coupled to and extending away from said outer wall of said housing, said power cord being electrically coupled to each of said light emitting units, said heating unit and said blower, said power cord having a distal end with respect to said outer wall, said distal end having a male plug being electrically coupled thereto wherein said male plug is configured to be electrically coupled to a power source comprising a female electrical outlet.

* * * * *